United States Patent [19]

Schaidl et al.

[11] Patent Number: 4,482,307

[45] Date of Patent: Nov. 13, 1984

[54] PRESS FOR PRODUCING TRUE-TO-SIZE WORKPIECES USING POWDER MATERIALS

[75] Inventors: Hubert Schaidl, Bichl; Dietmar Herren, Benediktbeuern, both of Fed. Rep. of Germany

[73] Assignee: Dorst-Maschinen und Anlagenbau Otto Dorst und Dipl.-Ing. Walter Schlegel GmbH & Co., Fed. Rep. of Germany

[21] Appl. No.: 412,398

[22] Filed: Aug. 30, 1982

[30] Foreign Application Priority Data

Oct. 23, 1981 [DE] Fed. Rep. of Germany ..... 3142126

[51] Int. Cl.[3] ..... B22F 3/00

[52] U.S. Cl. ..... 425/78; 425/352; 425/356

[58] Field of Search ..... 425/78, 352, 356, 375

[56] References Cited

U.S. PATENT DOCUMENTS

| | | | |
|---|---|---|---|
| 3,664,784 | 5/1972 | Sibley | 425/78 |
| 3,868,201 | 2/1975 | Jacobson et al. | 425/78 |
| 4,153,399 | 5/1979 | DeSantis | 425/78 |
| 4,270,890 | 6/1981 | Öttl | 425/352 |
| 4,370,119 | 1/1983 | Watanabe | 425/352 |

FOREIGN PATENT DOCUMENTS

| | | | |
|---|---|---|---|
| 2519708 | 11/1975 | Fed. Rep. of Germany | 425/808 |

*Primary Examiner*—Donald E. Czaja
*Assistant Examiner*—Mary A. Becker
*Attorney, Agent, or Firm*—Price, Heneveld

[57] ABSTRACT

A press designed for producing true-to-size workpieces from powder material has upper and lower platens, a base plate, a die support plate and a lower stamp, which is moved hydraulically in translation in relation to the base plate and the die plate. The die plate and the base plate are parts of a frame structure using pull-rods and having the die plate and a lower joining plate as parts thereof. The frame structure is joined with the top platen of the press by way of a connection piece, which may be moved in translation in relation to the frame structure in the direction of pressing, whereas the lower platen of the press is joined up with the lower joining plate. To get an even density in the pressed workpieces and to make possible the use of modern electronic control systems the lower stamp of the press is made up of at least two lower stamp parts which are supported on machine parts. These machine parts are supported in relation to the base plate by way of hydraulic piston and cylinder units and are stopped in the pressing position by way of stops which are fixed in relation to the press frame. Furthermore, for ejection of the pressed workpieces after moving down the die (and after faces of the workpieces have come clear of the die) the machine parts may be moved together in stages so that downwardly facing ring-like faces on the workpiece come clear of the stamp parts in turn.

12 Claims, 6 Drawing Figures

PRESS FOR PRODUCING TRUE-TO-SIZE WORKPIECES USING POWDER MATERIALS

GENERAL BACKGROUND OF THE INVENTION

The present invention is with respect to a press having a top platen and a lower platen for making true-to-size pressings of powder material. Such pressings or moldings may for example be gearwheels, pistons of shock-absorbers, synchronizers for automatic transmissions or the like. The pressings are generally made up of iron powder, ferrite powder and ceramic or such like powders.

One press on these lines, which has been used in the assignee's works, had a base plate, a die plate and a lower stamp able to be moved in translation in relation to the base plate and the die plate hydraulically, the base plate and the die plate being parts of a frame structure made up of the die plate and a lower joining plate with pull-rods for connection purposes, the frame structure being joined up by way of a connection piece, able to be moved in translation in relation to the frame structure in the direction of pressing, with the top platen, whereas the lower platen of the press is joined up with the lower joining plate.

In this earlier form of press the base plate took up the lower stamp which had a stepped form and, if desired, was made up of different stamp parts. On easing off or pulling down the lower stamp uneven forces were necessarily produced within the pressing or molding, even if the stamp was made up of a number of stamp parts, such forces being caused by friction between the parts of the die and stamp and the pressing which was to be taken from the mold. Frequently, such forces were a cause of damage to the pressing. A further shortcoming of the earlier press design was that it was hard to make certain of an even density within the pressing.

GENERAL OUTLINE OF THE INVENTION

In connection with such a press one purpose of the present invention is so changing the design that the density distribution in the pressed workpiece is made as even as possible.

A still further purpose of the invention is that of making it possible for the press to be controlled with modern control systems.

A still further purpose of the present invention, which is important in this respect, is that of balancing the different degrees of compression of the stamps by controlling the motion of parts of the press.

For effecting such purposes, and further purposes, machine parts, used for supporting lower stamps, are supported in relation to the base plate by hydraulic piston and cylinder units, such machine parts being seated and supported in the pressing position on stops fixed in relation to a frame of the press, and for ejection of the pressing after easing off the die (after being moved clear of those faces of the pressing which are in contact with the die) may be moved separately upwards in stages till the next contact face is freed and so on till all faces are cleared.

In such a press the pressing position is controlled or fixed by a lowermost fixed stop for all lower stamps and such stop may undergo adjustment to a certain degree if desired for the separate lower stamps, but on the other hand, after such adjustment, it is generally speaking controlling for the pressing position.

Ejection of the pressing or molding may take place very simply by first moving down the die, whereafter the pressing, supported by all the lower stamps and now clear of the die and while keeping the next lower stamp in the end position at the same level as the die, the rest of the lower stamps are moved upwards till the next stage or step on the pressing has been uncovered or freed. This upward motion, in steps or stages then goes on till the pressing is only supported on a middle lower stamp, from which it may be taken.

The order of these working steps is simply dependent on the form of the pressing. In every case it is, however, possible to make certain that on the pressing on ejection of the next stage only frictional forces are present within this stage or step so that the pressing is freed of the forces loading it stage by stage and in the round-the-pressing direction, for which reason overly great pulling off forces are not possible, which would otherwise be responsible for changes in the structure of the pressing. The pressing may be readily taken from a middle pin, if one is present, because it will have become somewhat wider in the process of unloading it step-by-step, and for this rcason may readily be taken from the press.

A specially useful effect produced by the invention is that each machine part supporting a lower stamp may be used with a measuring part fixed in relation to the base plate and which is used for measuring the motion of such machine parts into the filling or ejection position. In a very simple case, it will only be a question of a middle pin taking part in the motion of the die support plate, and whose speed in relation to the die or support plate may be freely controlled or changed. A useful effect is produced if the middle pin is fixed to the piston of a hydraulic cylinder, which is joined up with the lower joining plate.

It is possible, on using the press of the invention, for the separate machine parts, supporting the lower stamp, to be moved at different speeds, completely separately from each other, right from the start of the pressing operation and furthermore they may be moved in a way dependent on the pressure building up between the top stamp and the separate lower stamps, into their end-of-pressing position. Such control may be undertaken with the most modern systems on hand, for example with electronic automatic control systems.

The press of the invention makes it possible for all the lower stamps and furthermore the middle pin to be moved with desired speeds without being dependent on temperature pressure and friction conditions. In this way it is possible to get an accurately reproducible flow of powder in the compaction operation.

The number of different machine parts, each supporting a lower stamp, may readily be changed on designing the press and in fact is only limited by the amount of space in the press, in which such parts may be placed.

LIST OF FIGURES AND DETAILED ACCOUNT OF WORKING EXAMPLE OF THE INVENTION

Further useful effects and details of the invention will be seen from the detailed account now to be given of one working example thereof.

Figure 1:
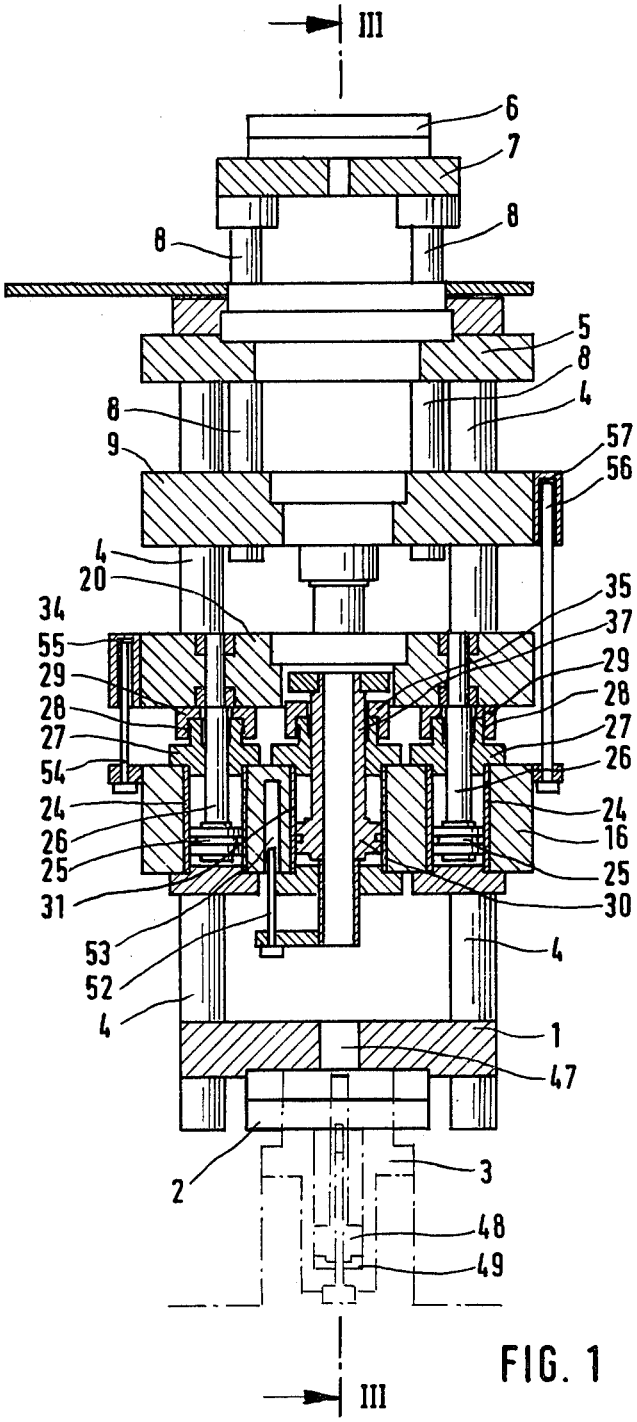
FIG. 1 is a vertical section through parts placed between the upper and lower platens of a press.
Figure 2:
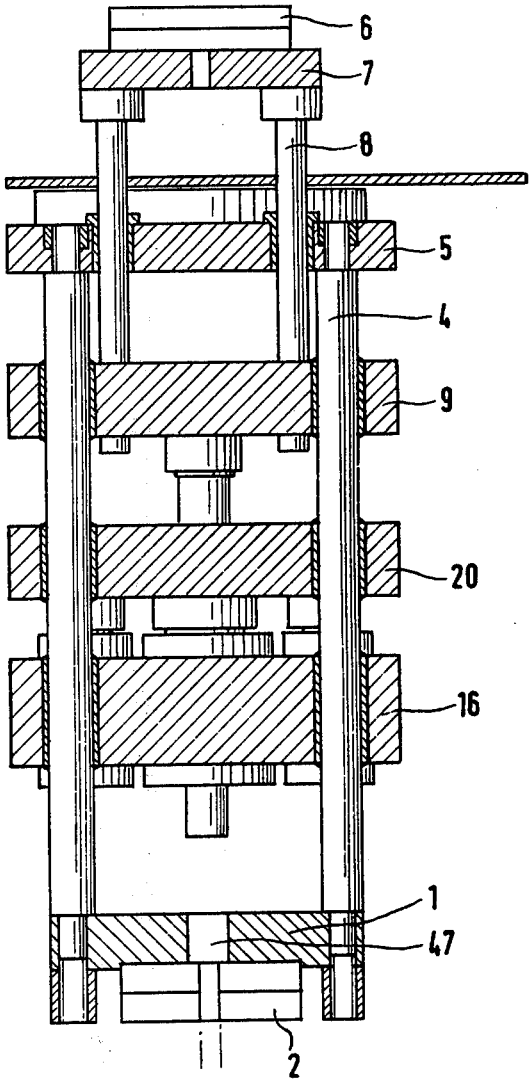
FIG. 2 is a section generally taken on the line II—II of FIG. 3.

In FIG. 1 the reader will see that the lower joining plate 1 is joined up by way of a connection piece 2 with a T-piece 3 which is part of the machine frame. By way of pullrods 4 the lower joining plate 1 is strongly connected with a die support plate 5. Connection piece 6 may be pushed along on the moving part, that is to say on the top stamp of the press and is joined up with the top joining plate 7 so that this plate is joined up with the top stamp of the press.

Figure 3:
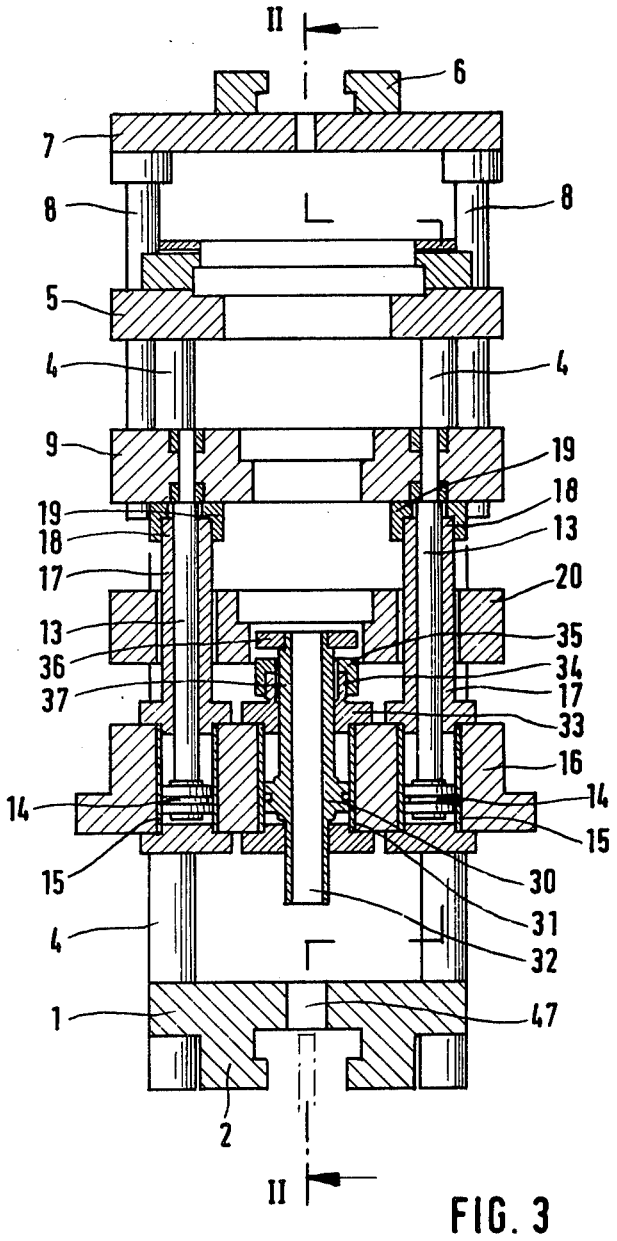
FIG. 3 is a section on the line III—III of FIG. 1.
Figure 4:
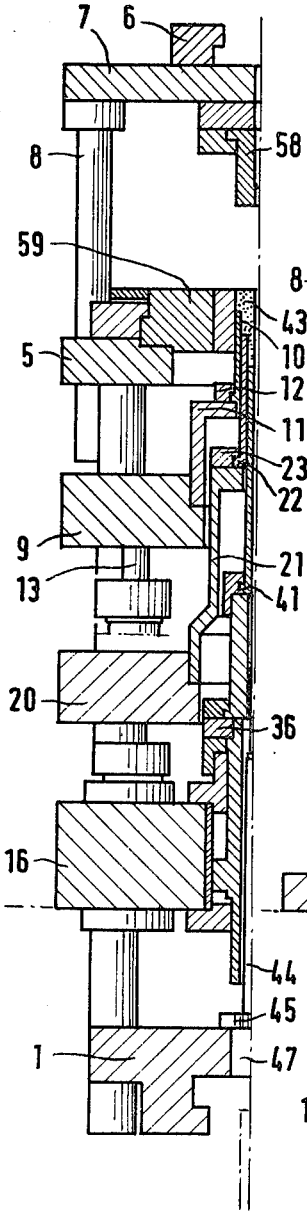
FIG. 4 is a section of half of the parts on generally the same lines as the section of FIG. 3 with the pressing tools in position for producing stepped workpieces, in the filling position and with the inbetween plate and the base plate turned through 90° to make clear certain parts of the press, which would otherwise not be seen.
Figure 5:
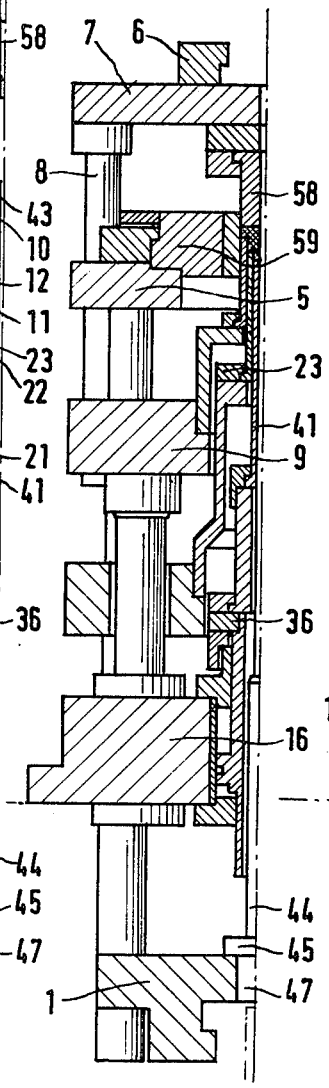
FIG. 5 is a half section on the same lines as that of FIG. 4, but in the later pressing position, the section planes having been turned through 90° out of the position of FIG. 4 to make some parts of the press clearer.

The top joining plate 7 is guided for motion in translation by way of guide bars 8 in the die support plate 5, said bars 8 being moved through openings of the right size therefor in the takeup plate 9 as the bars are moved from the filling position (FIG. 4) into the pressing position (FIG. 5). The takeup plate 9 takes up one or more stamps. It will be seen from FIGS. 4 to 6 that stamp 10 is fixed to take up plate 9 by way of a bridge 11 using a keeper ring 12. Piston rods 13 are fixed to the takeup plate 9 (see FIG. 3) and the pistons 14 thereof may be moved in hydraulic cylinders 15 in the base plate 16. Guide sleeves 17 are seated on the base plate 16 and have threads 18 at their top ends, onto which cap nuts 19 are screwed. By adjustment of such nuts on thread 18 the end-of-pressing position may be changed as desired. On an inbetween plate 20 a further stamp 22 is supported by way of a bridge 21, much like bridge 11, said stamp 22 as well being fixed on bridge 21 by the use of a keeper ring 23. In the base plate 16, which is fixed in relation to the press, there are, as will be seen from FIG. 1, two further cylinders 24 having pistons 25 whose piston rods 26 are guided in a cylindrical guide 27. Guide 27 is much like guide cylinder 17 and like it it has a thread 28 on which a cap nut 29 is screwed. The piston rod 26 is fixed in the inbetween plate 20. The cap nut 29 will be seen to make possible a change in the end-of-pressing position like the nut 19.

A further piston 30 (see FIG. 3) is present in base plate 16 and has a cylinder 31 therein. Such piston 30 has a middle opening 32 with a part running through it as will be detailed later herein. On base plate 16 there is a further guide 33 with a screw thread 34 on which a cap nut 35 is screwed for making changes in the end-of-pressing position of the piston 30 in cylinder 31. A stopping effect is produced using a takeup plate 36 which is fixed on the piston rod 37 of piston 30.

A headpiece 39 (see FIGS. 4 to 6) is seated on takeup plate 36 and a further stamp 41 is fixed on such headpiece 39 with the help of a keeper ring 40. In the present working example the stamp 31 is the innermost stamp. It is naturally possible to have, in place of the threefold stamp system in the present working example of the invention, a stamp system with more or less than three stamps which may furthermore be so worked that the steps on the molding or pressing 42 (FIG. 6), which is produced on the pressing compound 43 (FIG. 4) filled into the press, are at an opposite slope, that is to say in place of sloping upwards to the left such steps might be sloping upwards to the right. However such changes would still be fully within the general idea of the present invention. The stamps might furthermore placed in some different way as a further development of the invention as long as in fact there is more than one stamp.

The middle pin 44 is joined up with the lower joining plate 1 with or without the help of a collar 45 (see FIGS. 4 to 6), such pin 44 moving with the joining plate 1. The middle pin 44 has its top end at such a height that it is in line with the die support plate 5. Furthermore pin 44 may be freely moved through the opening 47 in the lower joining plate 1 and may be joined up with the piston 48 moved by a hydraulic cylinder 49 which is placed in the T-piece 3. For this reason it is not dependent on the motion of the die support plate 5.

Piston 30 in cylinder 31 has a rule 52 or scale running into and out of a hole 53 in base plate 16. Rule 52 is fixed to piston 30 so that it is moved therewith and makes it possible for the motion of piston 30 in relation to base plate 16 to be measured, for example using the system with electronic signal as its output representative of the reading, such signal going to the input of a control system. The design may be such that every 1/100 millimeter of motion one pulse is produced by the rule or scale and goes to the electronic control system and after a certain number of pulses has been produced the machine will be so controlled that the next motion takes place. This next motion will in the present working example be a motion of base plate 16 in relation to inbetween between plate 20 and is measured with the help of a rule 54 or scale, which is taken up in hole 55 in inbetween plate 20. The motion of the base plate 16 and the takeup plate 9 in relation to each other is measured with the help of a further rule 56 or scale running into the hole 57 of the takeup plate 9. If the middle pin 44, as we have seen, is joined up with the piston 48, it may be moved, again with the help of rule or scale (not marked in the figures) into any desired position in relation to the die support plate 5 at a desired speed and under full control. For this reason it is as well possible for it to be used to have an effect on the powder flow without being dependent on changes in temperature and friction. This puts an end to certain trouble conditions caused by the stamps 10, 22 and 41 and the middle pin 44 being heated up as the different steps of the pressing operation take place one after the other so that friction between the molding and such parts change within the contraction operation and lead to an uncontrolled flow of powder with changes in the density distribution in the pressed molding. Steps may now be taken for stopping this by automatically controlled motion of the stamps and of the middle pin from the filling into the pressing positions.

Figure 6:
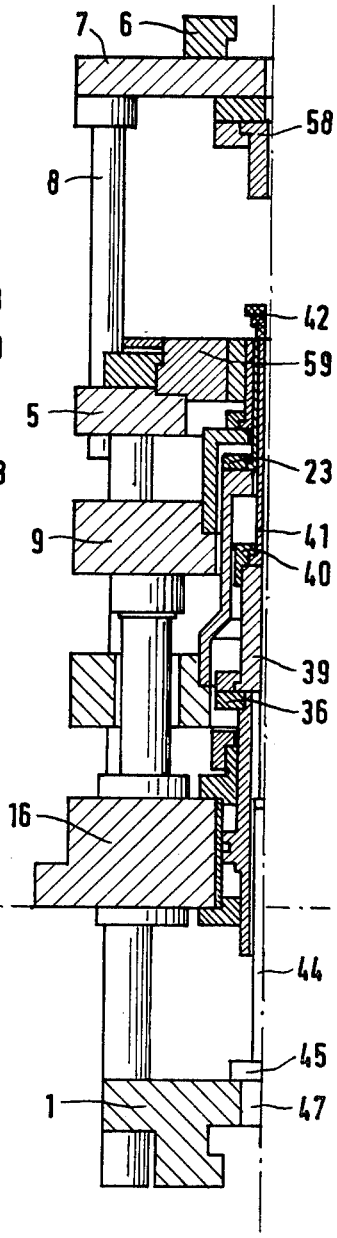
FIG. 6 is a half section on the same lines as FIGS. 4 and 5, as seen in the easing off and ejection position.

In FIGS. 4 to 6 it is furthermore possible to see the top opposite stamp or counter-stamp 58 fixed to the top joining plate 7 and which, at the filling stage, whose end may be seen in FIG. 4, has been moved so far from the die 59 supported in the die support plate 5 that the filling apparatus (which will generally be in the form of a filling slide or door) may be moved between the top opposite stamp 58 and the die inwards or outwards. The top opposite stamp 58 is moved partly into die 59 in the pressing stage, whose end will be clear from FIG. 5.

We claim:

1. A press for producing finished to gauge workpieces by compacting powdered material, comprising:

a removable frame structure adapted to be mounted between and detachably secured to the upper and lower platens of a die press, said removable frame structure including:

a substantially horizontally disposed die plate having a die opening extending downwardly therethrough;

upper stamp means above said die plate for downward movement into said die opening;

lower stamp means below said die plate having at least three stamp parts, each of said stamp parts being independently movable upwardly and downwardly in said die opening, each of said stamp parts having top end faces designed for forming at least one downwardly directed face of a workpiece within said die opening;

a base plate below said lower stamp means;

lower stamp hydraulic means associated with said base plate for independently moving each of said stamp parts upwardly and downwardly in said die opening;

one stop for each stamp part for supporting each stamp part in a stationary position with respect to said base plate while pressing is taking place in said die opening;

means for vertically moving said die plate in relation to said base plate.

2. The press as claimed in claim 1 wherein said stops are designed for adjustment.

3. The press as claimed in claim 2 wherein the stops are in the form of cap nuts, said press having guide sleeves on whose ends said nuts are screwed.

4. The press as claimed in claim 1 which further comprises a plate for movably supporting each of said stamp parts, and wherein said hydraulic means comprises at least one cylinder and piston unit for each of said plates, said cylinders being in said base plate, said pistons fixed to said supporting plates.

5. The press as claimed in claim 4 having, for each supporting plate, a measuring part fixed in relation to said base plate, said measuring part being designed for measuring motion of said plate into filling and ejection positions of said press.

6. The press as claimed in claim 5 wherein said supporting plates include an inbetween plate and a takeup plate, said measuring parts movable within holes in said base plate, said inbetween plate and said takeup plate.

7. The press as claimed in claim 1 which further comprises a pair of vertical pull rods connecting said die plate with said lower part of frame structure, said pull rods acting as guides for the vertical movement of at least one of said stamp parts.

8. The press as claimed in claim 7 which further comprises a lower joining plate on the lower part of said frame structure below said base plate for connecting said frame structure with a die press lower platen.

9. The press as recited in claim 8 which further comprises a connection piece secured to said upper stamp means for connecting said upper stamp means with a die press upper platen.

10. The press as recited in claim 1 wherein separate means are provided for moving said upper die plate and said lower die plate, said die plates in response to said separate means being movable simultaneously in the same direction such that said upper die plate moves toward said lower die plate faster than the lower die plate moves away from said upper die plate.

11. The press as recited in claim 8 which further comprises a middle pin connected to said lower joining plate and projecting upwardly into said die opening.

12. The press as recited in claim 11 which further includes a middle pin hydraulic unit having a piston connected to said pin and a cylinder in which said piston is disposed, for controlling the movement of said middle pin in relation to said die plate.

* * * * *